US005795137A

United States Patent [19]

Ozawa et al.

[11] Patent Number: 5,795,137

[45] Date of Patent: Aug. 18, 1998

[54] WATER PUMP FOR INTERNAL COMBUSTION ENGINES

[75] Inventors: Godo Ozawa, Utsunomiya; Hidetada Fukushima; Toshihiko Nishiyama, both of Oyama; Akihumi Hukui, Saitama; Masaki Shinohara, Oyama, all of Japan

[73] Assignee: Komatsu Ltd., Tokyo, Japan

[21] Appl. No.: 624,495

[22] PCT Filed: Sep. 26, 1994

[86] PCT No.: PCT/JP94/01576

§ 371 Date: Apr. 8, 1996

§ 102(e) Date: Apr. 8, 1996

[87] PCT Pub. No.: WO95/10696

PCT Pub. Date: Apr. 20, 1995

[30] Foreign Application Priority Data

Oct. 8, 1993 [JP] Japan ..... 5-059704 U

[51] Int. Cl.[6] ..... F04B 17/05

[52] U.S. Cl. ..... 417/362; 474/92

[58] Field of Search ..... 417/362, 367, 417/372; 474/92, 93, 166, 167, 188, 199

[56] References Cited

U.S. PATENT DOCUMENTS

| | | | |
|---|---|---|---|
| 4,618,334 | 10/1986 | Miranti, Jr. | 474/93 |
| 5,125,795 | 6/1992 | Suzuki et al. | 417/362 X |
| 5,490,814 | 2/1996 | Whitenight | 474/92 |

FOREIGN PATENT DOCUMENTS

| | | | |
|---|---|---|---|
| 61-144219 | 9/1986 | Japan . | |
| 62-18651 | 5/1987 | Japan . | |
| 2-59220 | 4/1990 | Japan . | |
| 5-321888 | 12/1993 | Japan . | |
| 2146408 | 4/1985 | United Kingdom | 474/93 |

*Primary Examiner*—Ismael Izaguirre

*Attorney, Agent, or Firm*—Sidley & Austin

[57] ABSTRACT

The present invention relates to a water pump for an internal combustion engine, capable of effectively preventing the entry of dust into a bearing for an impeller shaft, and of providing a simply constructed and small-sized dustproof function. To this end, a fan (32) is mounted on a portion of an impeller shaft (18) which is positioned within a cup-shaped hood (30), and the inflow of dust into the bearings (22F, 22R) is prevented by the fan (32). The hood (30) is provided with blowout holes (44) in the portions thereof which are opposed to the outer circumference of the fan (32).

17 Claims, 5 Drawing Sheets

WATER PUMP FOR INTERNAL COMBUSTION ENGINES

TECHNICAL FIELD

The present invention relates to a water pump for an internal combustion engine, and more particularly, to an improvement in a water pump to be mounted so as to rotate pump vanes utilizing the rotatory force of the engine.

BACKGROUND ART

Conventionally, a water pump for an internal combustion engine has been mounted on a construction machine and the like to be driven coaxially with a radiator fan (for example, see Japanese Utility Model Publication No. 62-18651). In this configuration, the water pump is constructed as a centrifugal pump as shown in FIG. 5. An impeller 2 is contained in a pump housing 1, and a rotary shaft 3 of the impeller 2 is supported, through bearings 5, by an extension portion 4 of the pump housing 1. An end of this rotary shaft 3 projects from a shaft insertion hole 6 of the extension portion 4, and a hood 8 is mounted to the projecting portion of the shaft 3. This hood 8 is shaped so as to cover the extension portion 4 and includes a rotation transmitting pulley 7 at an outer circumferential surface portion thereof. A rotation transmitting belt from a drive shaft of the internal combustion engine is looped over the pulley 7, and a pumping action is effected by rotation of the shaft 3.

Incidentally, this type of water pump is mounted on a radiator portion of the internal combustion engine. Therefore, since the pump is disposed in an environment where it is exposed to dust and the like, the shaft insertion hole 6, which the bearing 5 is facing, is enclosed by the hood 8, and an oil and dust seal 9 is position in the shaft insertion hole 6. In this way, the bearing 5 may be protected from dust and the like.

However, according to the construction of the above described water pump for an internal combustion engine, it is necessary to mount the dust seal 9 and the like so as to prevent dust in a space 10 from entering the bearing 5, which is provided on the forward portion of the water pump. For this reason, there is a problem in that the structure becomes complicated, and the diameter of the pump housing 1 increases so that the pump itself becomes large in size.

SUMMARY OF THE INVENTION

The present invention has been made to solve the drawbacks of the prior art, and particularly has an object to provide a water pump for an internal combustion engine capable of effectively preventing the entry of dust into a bearing for the impeller shaft.

A first aspect of a water pump for an internal combustion engine according to the present invention is characterized in that a boss having a fan integrally formed on the outer circumferential portion thereof is mounted on the impeller shaft, and the boss is detachably mounted on the inner side of the hood, and that the inflow of dust into the bearings is prevented by the fan. In addition, the hood can be provided with radial blowout holes adjacent to the outer circumference of the fan.

By such a construction, the fan is mounted to the impeller shaft and rotates with the impeller shaft, and the dust which would enter into the bearing portion can be discharged outwardly by wind pressure from-the rotation of the fan. More particularly, by the provision of the blowout holes in the hood, the fan can blow external air from within the hood out through the blowout holes. That is, dust enters from the edge opening, formed between the pulley end of the hood and the pump housing, and from the blowout holes, but strikes the rotating fan to be blown out radially around the circumference of the fan. Since the blown-out dust is discharged outwardly from the blowout holes which are formed radially, the entry of dust into the bearing portion can be prevented. On the other hand, when the blowout holes are not provided, dust is not necessarily discharged rapidly due to the fact that dust blown out by the fan impacts against the inner surface of the hood and returns. However, a rapid discharge property can be obtained by providing the blowout holes. Furthermore, since the entry of dust can be effectively prevented by a small fan power, there is no need to increase the diameter of the pump housing, thus permitting a small-sized water pump.

A second aspect is characterized in that vanes are provided on the inner surface of the pulley end of the hood, and air-inlet holes are formed on the end of the hood which is mounted to the impeller shaft, and that the vanes discharge air from within the hood so as to prevent the inflow of dust into the bearings.

By such a construction, dust which would enter from the edge opening of the side of the pulley end of the hood can't enter because the dust is repelled by the rotating fan. In addition, a flow of air from the air-inlet holes to the edge opening is formed by rotation of the vanes, and dust is discharged by the flow from the edge opening to the outside. As a result, the bearing portion is protected.

BRIEF DESCRIPTION OF DRAWINGS

FIGS. 3A and 3B are views showing a fan of the first embodiment, in which FIG. 3A is an end view and FIG. 3B is a sectional view;

BEST MODE FOR CARRYING OUT THE INVENTION

The preferred embodiments of a water pump for an internal combustion engine according to the present invention will be described in detail with reference to the attached drawings.

Figure 1:
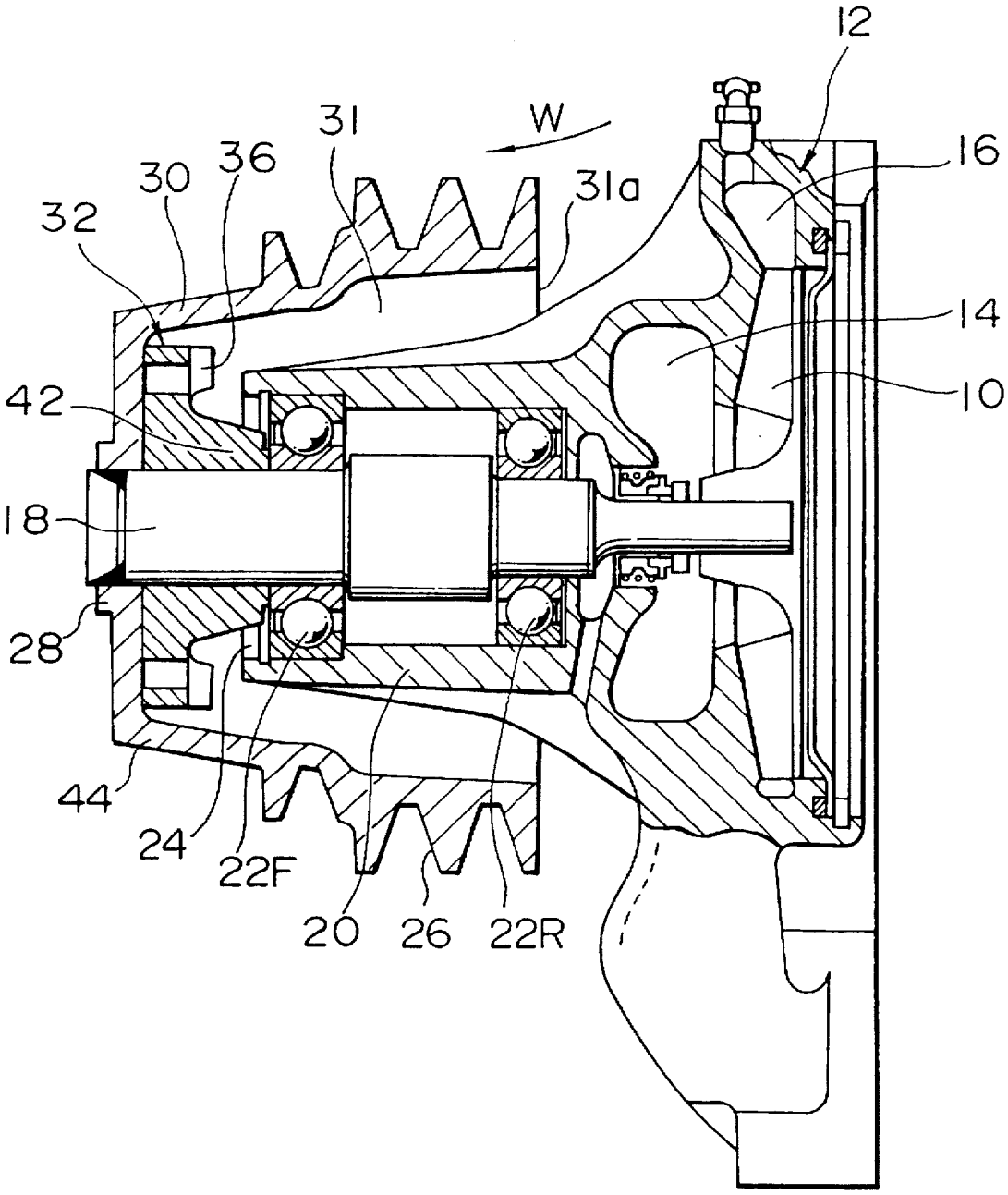
FIG. 1 is a sectional view of a water pump for an internal combustion engine according to a first embodiment of the present invention.

FIG. 1 shows a water pump for an internal combustion engine according to the present invention. This pump is constructed as a centrifugal pump. The inside of a pump housing 12 (hereinafter, referred to as a housing 12), containing an impeller 10, is divided by the impeller 10 into a suction chamber 14 and a discharge chamber 16. The housing 12 has an extension portion 20 extending toward the front, i.e., in the opposite direction to the impeller 10 side. The suction chamber 14, which is to be connected to an inflow tube portion (not shown), is open to the center portion of the impeller 10, while the discharge chamber 16, which is to be connected to an outflow tube (not shown), is formed on the outer peripheral portion. When the water pump is actuated, a rotation of the impeller 10 imparts rotary motion to cooling water, which is pumped outwardly from the center of the impeller 10 and discharged into the discharge chamber 16. Also, a rotary shaft (impeller shaft) 18, for rotating the impeller 10, is mounted to the impeller 10. The rotary shaft 18 is rotatably mounted through a pair of bearings 22 (22F, 22R) which are provided within the extension portion 20.

Further, an end of the rotary shaft 18 projects from a shaft insertion hole 24 in the extension portion 20, and a cup-shaped hood 30 is secured to the outer circumference of the tip of the projected portion of the shaft 18 by means of a mounting boss 28. A pulley 26 is formed on the outer circumference of the impeller 10 side of the hood 30, so that an engine fan belt can be looped over the pulley 26. The cup-shaped hood 30 is formed-in the shape of a bowl so as to enclose the extension portion 20 of the housing 12 and form a predetermined annular space 31 therebetween. Thus, the pulley 26 is formed on the outer circumference of the hood 30 outwardly of the extension portion 20 so as to reduce the axial length of the water pump. The above-described water pump transmits rotatory power of an engine (not shown), which is a rotation drive source, to the pulley 26 to rotate the impeller 10.

Figure 3A:
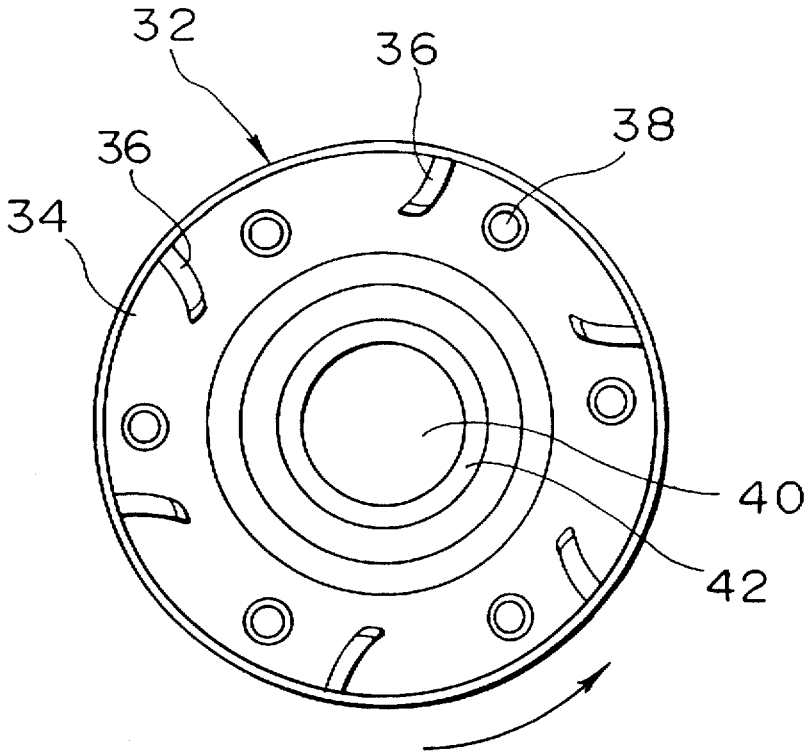
Figure 3B:
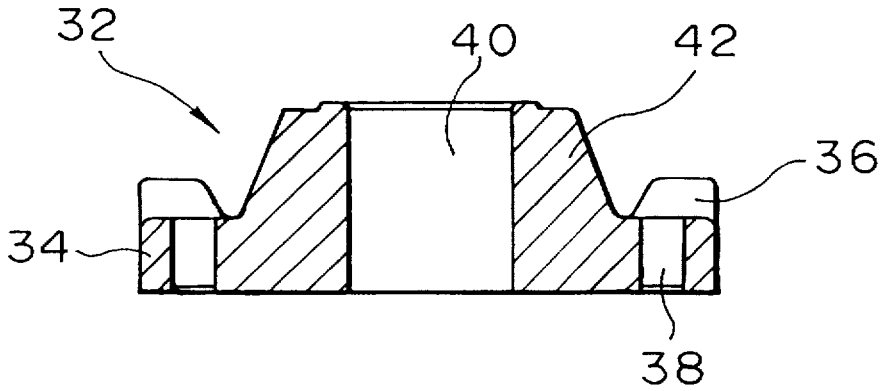

However, there is a possibility that external air can enter into the space 31, between the outer circumference of the extension portion 20 and the hood 30, through an opening 31*a* at the edge of the pulley 26, and dust will enter together with the external air. Accordingly, there is a danger that dust may get into the bearing 22F, provided at the entrance side of the shaft insertion hole 24. Thus, the water pump according to this embodiment includes a fan 32 to be attached to the rotary shaft 18 inside the cup-shaped hood 30, and between the boss 28 and the shaft insertion hole 24. This fan 32 is, as shown in detail in FIGS. 3A and 3B, of a multiblade type in which the vanes 36 are formed on one side of the flange member 34. The flange member 34 of the fan 32 is provided with the tapped holes 38 for securing to a bottom plate portion of the hood 30, and the fan 32 can rotate integrally with the hood 30.

Also, in the center of the flange member 34 of the fan 32, a boss 42 is provided for forming an insertion hole 40, allowing the rotary shaft 18 to pass therethrough. The boss 42 projects toward the shaft insertion hole 24 side to form a throttle taper, and the tip of the boss 42 abuts against an inner race of the bearing 22F, which is mounted inside the shaft insertion hole 24. And, a plurality of vanes 36 are provided on one side of the outer circumferential section of the flange member 34. These vanes 36 are equally spaced in a circumferential direction, and have circular arc cross-sectional configurations projecting against the space 31. By these components, the fan 32 rotates together with the hood 30, which is rotated by means of the pulley 26, and the vanes 36 rotate with the circular arcs thereof directed forwardly. By rotation of these vanes 36, air within the space 31 around the outer circumference of the extension portion 20 and air in the vicinity of the shaft insertion hole 24 are sucked and discharged to the outer circumference side of the fan 32.

Figure 2:
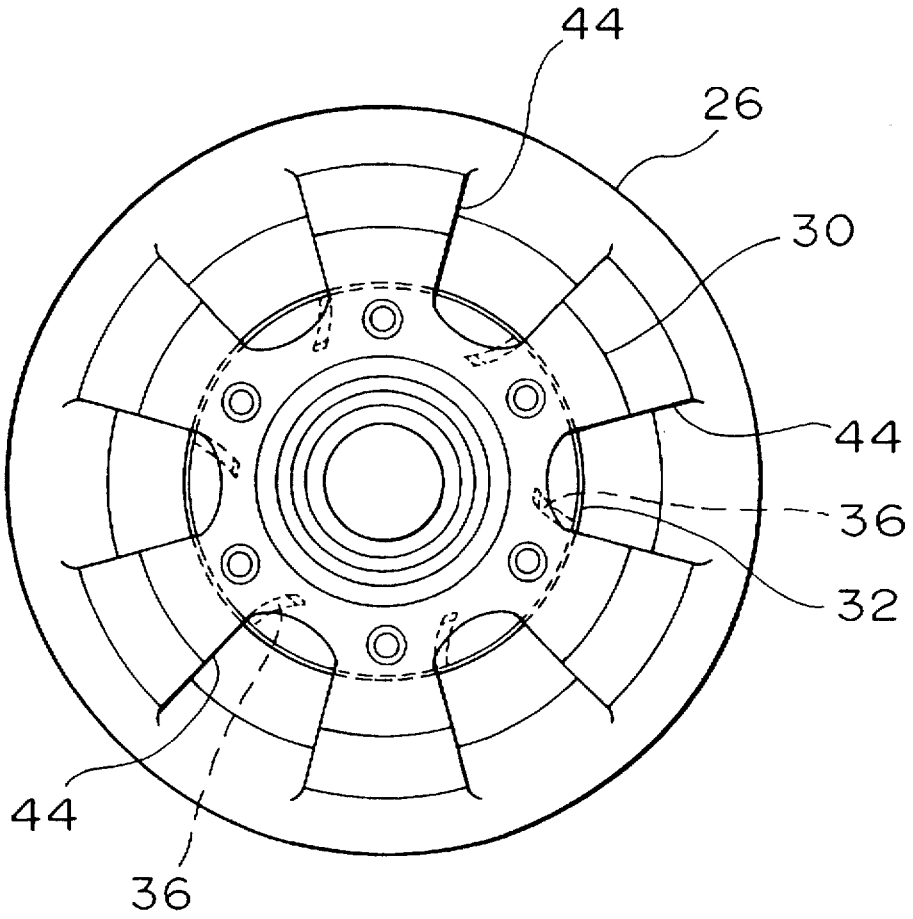
FIG. 2 is a front end view of the first embodiment.

The air discharged by the fan 32 flows toward the outer circumference of the fan 32. Thus, in this embodiment, the blowout holes 44 are formed on a wall surface portion of the hood 30 opposite to the outer edge of the fan 32. These blowout holes 44 are formed to be as many as the vanes 36, as shown in FIG. 2, and discharge the air, discharged by the fan 32, to the outside of the water pump.

By such a construction, the rotatory power of the engine is transmitted through the fan belt to the pulley 26 in order to rotate the rotary shaft 18, which is connected to the cup-shaped hood 30, and further, to rotate the impeller 10 for effecting a pumping action. When the pump is operated, the fan 32, secured to the bottom plate portion of the hood 30, rotates simultaneously. This fan 32 is of a multiblade type such that the vanes 36 project against the space 31, suck in air within the space 31 and in the vicinity of the shaft insertion hole 24, and blow out the air toward the outer circumference of the fan 32. The wall surface of the hood 30, where the air is blown out, is provided with blowout holes 44, and the blown-out air is discharged to the outside therethrough. Therefore, the external air containing dust, which enters into the inside of the hood 30 during the operation of the pump, flows from the opening 31a at the edge of the space 31 along the extension portion 20 toward the shaft insertion hole 24. However, the external air is sucked by the fan 32 without reaching the shaft insertion hole 24. Consecutively, the external air is blown outwardly toward the outer circumference of the fan 32 so as to be discharged to the outside via the blowout holes 44 in the hood 30. Therefore, the entry of dust from the shaft insertion hole 24 into the bearings 22 is eliminated.

As described above, according to the first embodiment, dust which would enter into the shaft insertion hole 24 of the pump housing 12 is discharged to the outside via the blowout holes 44 by means of the fan 32, which rotates together with the hood 30. As a result, dust can be prevented from getting into the bearings 22 without providing an exceptional dust seal. Thus, a water pump which is small-sized, simply constructed such that the fan 32 is mounted therein, and having a dustproof function can be obtained.

Incidentally, in FIG. 1 showing the first embodiment, it is more effective that the wind direction of an ejection fan (not shown) which is disposed separately from the water pump is shown by the arrow W. That is, dust is discharged by the fan 32 to the outside via the blowout holes 44 and is sucked from the blowout holes 44 under reduced pressure due to the air flow represented by the arrow W. Thus, it becomes more difficult for dust to enter into the bearings 22.

Next, a water pump for an internal combustion engine according to a second embodiment will be described with reference to the drawing.

Figure 4:
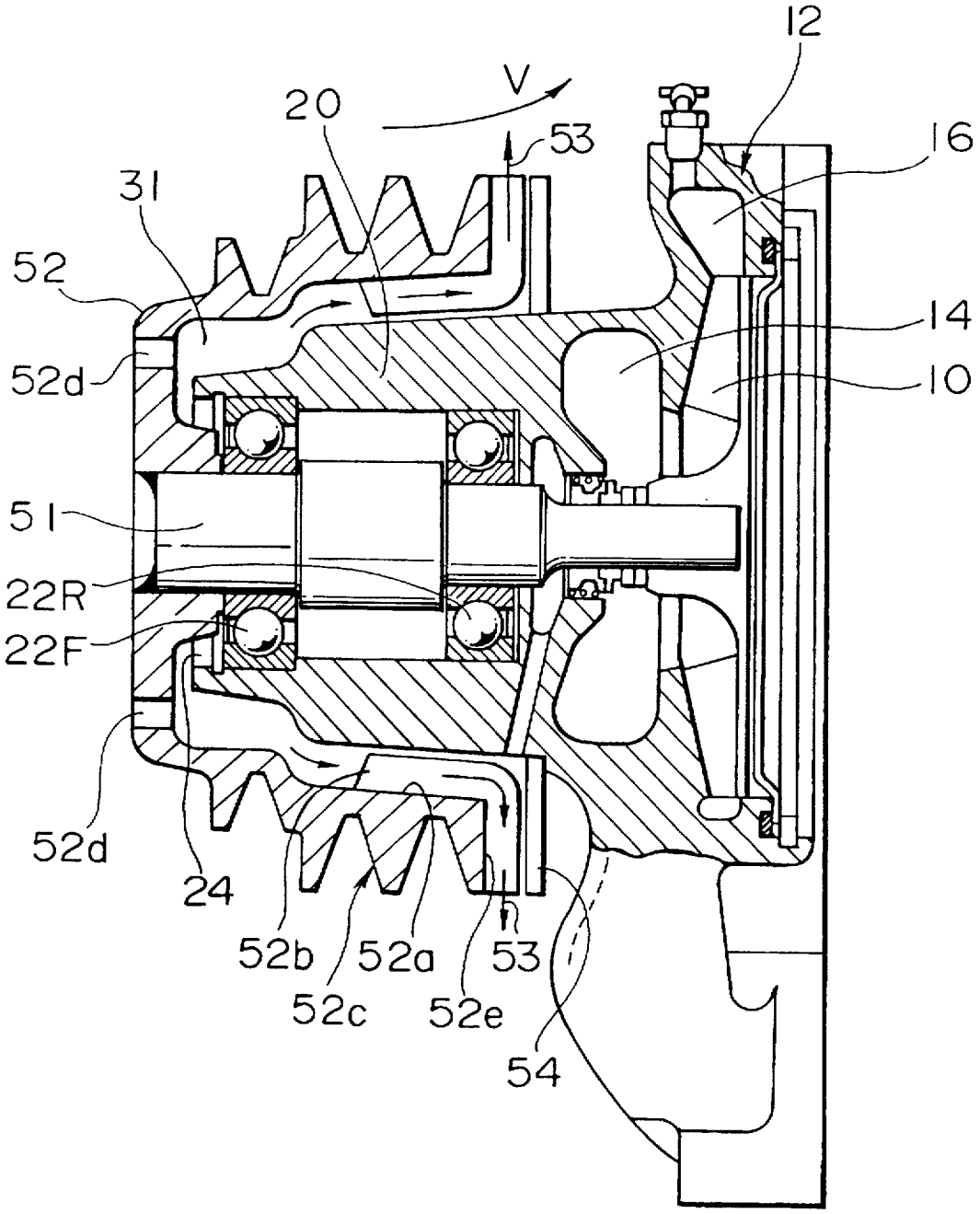
FIG. 4 is a sectional view of a water pump for an internal combustion engine according to a second embodiment of the present invention.
Figure 5:
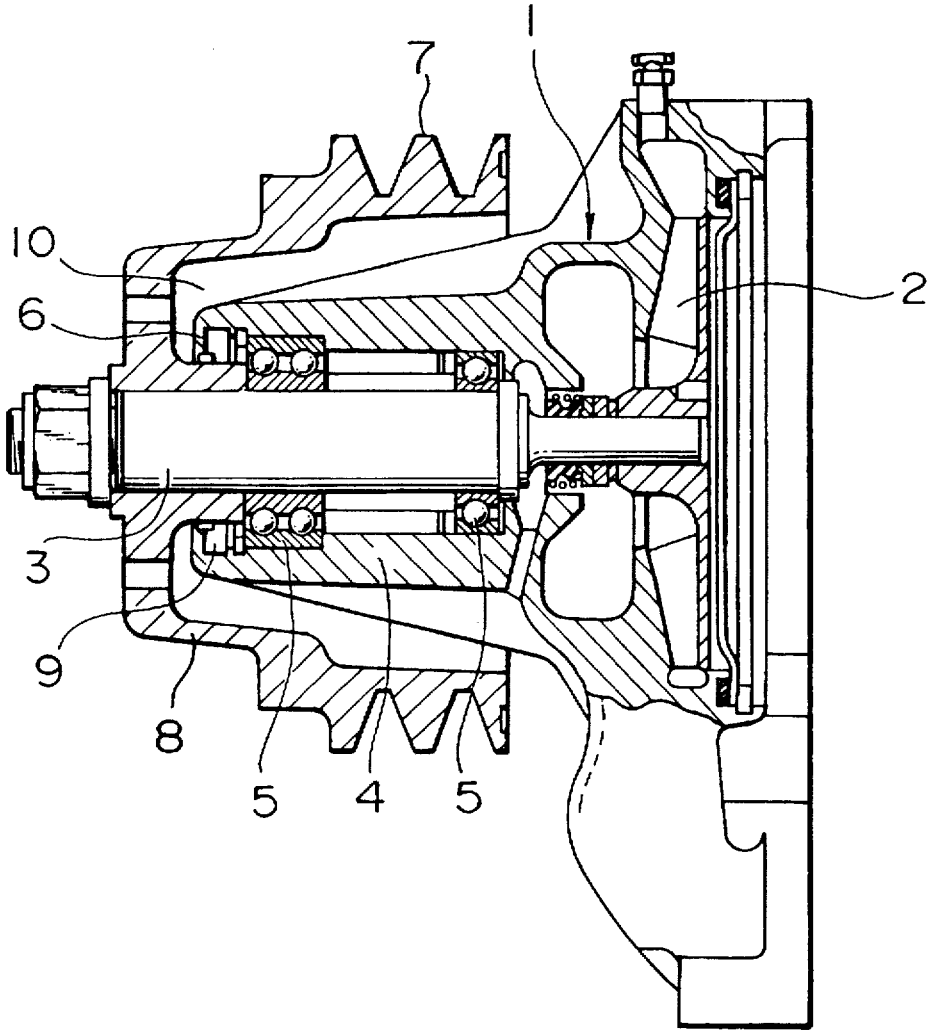
FIG. 5 PRIOR ART
FIG. 5 is a sectional view of a water pump for an internal combustion engine according to the prior art.

In FIG. 4, which is similar to the first embodiment, a rotary shaft 51 projects from the shaft insertion hole 24 in the extension portion 20, and a cup-shaped hood 52 is attached to the projected portion of the shaft 51. The cup-shaped hood 52 includes a pulley 52*c*, over which an engine fan belt is looped, and with the extension portion 20 forms the predetermined space 31. In addition, a plurality (for example, six) of vanes 52*b* are provided on the inner circumferential surface 52*a* of the hood 52. These vanes 52*b* project inwardly from the inner circumferential surface 52*a* toward the extension portion 20, and axially from the hood end surface 52*e* toward a shroud plate 54, respectively. Further, the vanes 52*b* are equally spaced in a circumferential direction, and have predetermined curvatures along the direction of their length. In addition, small air-inlet holes 52*d* are formed in the hood 52 near a mounting portion of the rotary shaft 51.

By such a construction, the vanes 52*b* rotate with the rotation of the pulley 52*c* to suck air within the space 31 and air flowing from the air-inlet holes 52*d*, and blow out the air in the direction of the arrows 53 to discharge the air outside of the water pump. Therefore, since the air within the space 31 containing small dust is discharged, the entry of dust from the shaft insertion hole 24 into the bearings 22 is eliminated, thereby preventing damage of the bearings 22 in a manner similar to that of the first embodiment.

Particularly, according to the above-described embodiment shown in FIG. 4, when the wind direction of a suction engine fan (not shown) is shown by the arrow V, dust is sucked from a discharge portion under reduced pressure due to air flow of the arrow V, thereby more securely preventing the entry of dust into the bearings 22.

Although a water pump for an internal combustion engine according to the present invention has been described above in detail, it is not limited to the above-described embodiments. For example, although the fan 32 is mounted on the hood 30, it can be mounted on the rotary shaft 18. In addition, it is possible to form the vanes 36 directly on the inner surface of the bottom plate portion of the hood 30, so that the fan 32 is united with the hood 30. Further, although the fan 32 is of a multiblade type, the shapes of the vanes can be set so that the fan becomes a so-called ejection type such that the blowout direction thereof is the opening 31*a* at the edge of the space 31. In this case, the blowout holes 44 do not need to be provided.

INDUSTRIAL APPLICABILITY

Since a fan rotating with a pulley is provided, the present invention can effectively prevent the entry of dust into a bearing for an impeller shaft, and is useful as a water pump for an internal combustion engine which is small-sized and simply constructed, and has a dustproof function.

We claim:

1. A pump comprising:

a pump housing;

an impeller shaft;

bearings positioned in said pump housing for mounting said impeller shaft;

a cup-shaped hood having a mounting end and a pulley end, a pulley formed on an outer circumferential surface of said pulley end, said mounting end being mounted on said impeller shaft so that said cup-shaped hood encloses a portion of said pump housing and defines a space between said portion of said pump housing and said cup-shaped hood and so that rotation of said pulley is transmitted to said impeller shaft; and a boss positioned within said cup-shaped hood and being mounted so that said boss rotates with said impeller shaft and said cup-shaped hood, said boss having a fan integrally formed on an outer circumferential portion of said boss so that an inflow of dust through said space into said bearings is prevented by an airflow created by rotation of said fan;

wherein said cup-shaped hood is provided with a number of blowout holes in the portions thereof which are radially adjacent to an outer circumference of said fan.

2. A pump in accordance with claim 1, wherein said boss has an end surface which faces said pump housing, and wherein said fan comprises a number of vanes integrally formed on said end surface, with the number of said plurality of vanes being equal to the number of said blowout holes.

3. A pump in accordance with claim 1, further comprising an impeller mounted on said impeller shaft for pumping water to an internal combustion engine.

4. A pump in accordance with claim 1, wherein said boss is positioned on said impeller shaft adjacent and in contact with a portion of said bearings.

5. A pump in accordance with claim 4, wherein said boss is tapered inwardly toward said impeller shaft and said portion of said bearings.

6. A pump in accordance with claim 1, wherein said boss is detachably secured to said cup-shaped hood.

7. A pump in accordance with claim 1, wherein said boss has an end surface which faces said pump housing, and wherein said fan comprises a plurality of vanes integrally formed on said end surface.

8. A pump in accordance with claim 7, wherein said vanes are equally spaced about the circumferential portion of said end surface.

9. A pump in accordance with claim 7, wherein each of said vanes has a circular arc configuration projecting into said space.

10. A pump in accordance with claim 1, wherein said pulley end of said cup-shaped hood is spaced from said pump housing so as to form an opening therebetween.

11. A pump comprising:

a pump housing;

an impeller shaft;

bearings positioned in said pump housing for mounting said impeller shaft;

a cup-shaped hood having a mounting end and a pulley end, a pulley formed on an outer circumferential surface of said pulley end, said mounting end being mounted on said impeller shaft so that said cup-shaped hood encloses a portion of said pump housing and defines a space between said portion of said pump housing and said cup-shaped hood and so that rotation of said pulley is transmitted to said impeller shaft, said mounting end of said cup-shaped hood having at least one air inlet opening therethrough in communication with said space; and vanes provided on an inner surface of said pulley end of said cup-shaped hood and projecting inwardly into said space for creating an airflow out of said space upon rotation of said cup-shaped hood, thereby preventing inflow of dust through said space into said bearings.

12. A pump in accordance with claim 11, further comprising an impeller mounted on said impeller shaft for pumping water to an internal combustion engine.

13. A pump in accordance with claim 11, wherein said pulley end of said cup-shaped hood has a hood end surface which is spaced from said pump housing so as to form an opening therebetween.

14. A pump in accordance with claim 11, wherein said vanes are equally spaced about said inner surface of said pulley end of said cup-shaped hood.

15. A pump in accordance with claim 14, further comprising a shroud plate positioned adjacent said pulley end, wherein said pulley end of said cup-shaped hood has a hood end surface which is spaced from said shroud plate so as to form an opening therebetween, and wherein said vanes project inwardly from the inner surface of said pulley end of said cup-shaped hood into said space and toward said pump housing and also axially from said hood end surface toward said shroud plate.

16. A pump in accordance with claim 15, wherein said at least one air inlet opening comprises a plurality of air inlet openings extending through said mounting end of said cup-shaped hood in communication with said space, whereby air is sucked through said plurality of air inlet openings and ejected outwardly through the opening between the hood end surface and the shroud plate.

17. A pump in accordance with claim 11, wherein said at least one air inlet opening comprises a plurality of air inlet openings extending through said mounting end of said cup-shaped hood in communication with said space.

* * * * *